US007147452B2

(12) United States Patent
Everett et al.

(10) Patent No.: US 7,147,452 B2
(45) Date of Patent: Dec. 12, 2006

(54) METHOD AND SYSTEM FOR FABRICATING STRUCTURAL BUILDING BLOCKS

(76) Inventors: Steve Eugene Everett, 1619 Wheless La., Austin, TX (US) 78723; Jay Dean Everett, 1619 Wheless La., Austin, TX (US) 78723

( * ) Notice: Subject to any disclaimer, the term of this patent is extended or adjusted under 35 U.S.C. 154(b) by 0 days.

(21) Appl. No.: 11/172,758

(22) Filed: Jul. 2, 2005

(65) Prior Publication Data

US 2006/0208386 A1 Sep. 21, 2006

Related U.S. Application Data

(60) Provisional application No. 60/662,229, filed on Mar. 17, 2005.

(51) Int. Cl.
*B28B 3/08* (2006.01)

(52) U.S. Cl. ..... 425/354; 425/352; 425/259; 425/260; 425/261; 425/422; 425/447; 425/436 R

(58) Field of Classification Search ..... 425/259, 425/260, 261, 354, 355, 352, 422, 441, 447, 425/436 R See application file for complete search history.

(56) References Cited

U.S. PATENT DOCUMENTS 266,532 A 10/1882 Ross
433,171 A 8/1890 Davis et al.
3,225,409 A 12/1965 Huffaker
4,640,671 A 2/1987 Wright
5,358,760 A 10/1994 Furlong et al.
6,224,359 B1 5/2001 Domazet
2002/0105107 A1* 8/2002 Everett ..... 264/69
2005/0025853 A1* 2/2005 Ness ..... 425/441

* cited by examiner

*Primary Examiner*—Joseph S. Del Sole
*Assistant Examiner*—Maria Veronica Ewald
(74) *Attorney, Agent, or Firm*—David O. Simmons

(57) ABSTRACT

A block forming apparatus comprises a frame, a compression case and compression bodies. The compression case is movably engaged with the frame in a manner enabling movement of the compression case along a longitudinal reference axis of the compression case. The compression case has a compression body receiving passage extending between opposed end faces thereof along the longitudinal reference axis. The compression case includes a media fill opening within an upper wall thereof and a block discharge opening within a lower wall thereof. The media fill opening and the block discharge opening are each communicative with the compression body receiving passage. The compression bodies are movably mounted within the compression body receiving passage of the compression case in a manner enabling movement of said compression bodies along the longitudinal reference axis of the compression case.

13 Claims, 6 Drawing Sheets

METHOD AND SYSTEM FOR FABRICATING STRUCTURAL BUILDING BLOCKS

CROSS REFERENCE TO RELATED APPLICATIONS

This patent application claims priority to co-pending U.S. Provisional Patent Application having Ser. No. 60/662,229 filed, Mar. 17, 2005, entitled "Soil, Materials Block Press", having a common applicant herewith and being incorporated herein in its entirety by reference.

FIELD OF THE DISCLOSURE

The disclosures made herein relate generally to structural building blocks and, more particularly, to methods and systems configured for fabricating structural building blocks such as, for example those consisting of compressed soil, clay and/or aggregate materials.

BACKGROUND

The formation of building blocks from compaction of materials such as, for example, soil, clay and/or aggregate is a well-known process utilized throughout the world. These types of structural building blocks are commonly and generically referred to as Abode blocks. Throughout the years, various applications designed to automate this process have been produced. Examples of known equipment configured specifically or similarly for fabricating building blocks by compaction of materials (i.e., conventional building block fabrication equipment) are disclosed in U.S. Pat. Nos. 266,532; 435,171; 3,225,409, 4,640,671, 5,358,760 and 6,224,359.

Such conventional building block fabrication equipment is known to suffer from one or more drawbacks. One such drawback is that they involve relatively complex mechanical procedures that adversely effect productivity in the number of blocks fabricated in a particular period of time and/or portability of the equipment itself. Another drawback is that they are limited in their ability to readily and efficiently produce building blocks of different sizes and/or shapes. Still another drawback is that they do not readily allows for two or more systems to be joined and operated simultaneously or independently, while maintaining easy access to replaceable components.

Therefore, method and systems that overcomes drawbacks associated with conventional methods and systems for fabricating structural building blocks would be useful, advantageous and novel.

SUMMARY OF THE DISCLOSURE

Embodiments of the present invention relate to a block forming apparatus that is relatively compact and relatively simple in construction and to a method for fabricating building blocks through the use of such an apparatus. Block presses in accordance with the present invention are constructed for enabling different styles and/or sizes of building blocks to be made in a relatively quick and efficient manner. Accordingly, the present invention advantageously overcomes one or more shortcomings associated with conventional block presses and methods for fabricating building blocks through compaction of compressible materials.

In one embodiment of the present invention, a block forming apparatus comprises a frame, a compression case and compression bodies. The compression case is movably engaged with the frame in a manner enabling movement of the compression case along a longitudinal reference axis of the compression case. The compression case has a compression body receiving passage extending between opposed end faces thereof along the longitudinal reference axis. The compression case includes a media fill opening within an upper wall thereof and a block discharge opening within a lower wall thereof. The media fill opening and the block discharge opening are each communicative with the compression body receiving passage. The compression bodies are movably mounted within the compression body receiving passage of the compression case in a manner enabling movement of the compression bodies along the longitudinal reference axis of the compression case.

In another embodiment of the present invention, a block press comprises a chassis, a block forming apparatus carriage, a block forming apparatus, a compression case actuator, a first compression body actuator and a first compression body actuator. The chassis includes spaced apart bulkheads. The block forming apparatus carriage is engaged with the chassis between the bulkheads. The block forming apparatus includes a frame, a compression case and two compression bodies. The frame is releasably engaged with the block forming apparatus carriage. The compression case is movably engaged with the frame in a manner enabling movement of the compression case along a longitudinal reference axis of the compression case. The compression case has a compression body receiving passage extending between opposed end faces thereof along the longitudinal reference axis. The compression bodies are movably mounted within the compression body receiving passage of the compression case in a manner enabling movement of the compression bodies along the longitudinal reference axis of the compression case. The compression case actuator is connected between one of the bulkheads and the block forming apparatus for facilitating the movement of the compression case. The first compression body actuator engaged between a first one of the compression bodies and a first one of the bulkheads for facilitating the movement of the first one of the compression bodies.

In another embodiment of the present invention, a method comprises a plurality of operations for forming a structural building block from a compressible media such as soil. One operation includes facilitating relative positioning of a compression case and two opposed compression bodies movably mounted within a compression body receiving passage of the compression case for forming a media receiving cavity within the compression body receiving passage between the compression bodies. Another operation includes facilitating relative positioning of the compression case for closing an entry into the media receiving cavity through which a volume of media was deposited after the volume of media is deposited within the media receiving cavity. Still another operation includes moving at least one of the compression bodies toward the other one of the compression bodies under sufficient force to compress the media into a structural building block.

Turning now to specific aspects of the present invention, in at least one embodiment, the compression case includes side walls extending between the upper wall of the compression case and the lower wall of the compression case, the upper wall, the lower wall and the side walls each include a respective interior surface that jointly define the compression body receiving passage, the respective interior surface of each one of the side walls has a block release recess therein extending between the upper wall and the lower wall, and the block release recess in each one of the side walls is positioned between a forward lateral edge of the block discharge opening and a rear lateral edge of the block discharge opening.

In at least one embodiment of the present invention, the block discharge opening intersects an end of the compression case.

In at least one embodiment of the present invention, at least one of the compression bodies has a media compaction portion and an actuator engagement portion connected to the media compaction portion, the media compaction portion has an intimate fit within the compression body receiving passage and the actuator engagement portion includes a generally flat engagement flange.

In at least one embodiment of the present invention, the block forming apparatus carriage and the chassis are jointly configured for enabling lateral movement of the block forming apparatus with respect of a longitudinal reference axis of the chassis.

In at least one embodiment of the present invention, a substantially rigid member engaged between a second one of the compression bodies and a second one of the bulkheads.

In at least one embodiment of the present invention, facilitating relative positioning for forming the media receiving cavity includes moving the compression case to a respective media loading position relative to a frame on which the compression case is movably mounted and moving at least one of the two opposed compression bodies to a respective media loading position relative to the compression case whereby the media receiving cavity is provided within the compression body receiving passage between the compression bodies.

In at least one embodiment of the present invention, a method for forming a structural building block from a compressible media further comprises facilitating relative positioning of the compression case and the two opposed compression bodies for enabling discharge of the structural building block through a block discharge opening in a wall of the compression case.

In at least one embodiment of the present invention, facilitating relative positioning for enabling discharge includes removing at least a portion of the force applied to the compression bodies whereby the compression bodies are in substantially non-compressing engagement with the structural building block, moving the compression case to a block discharging position with respect to the compression bodies whereby the block discharge opening is aligned with the structural building block and retracting the at least one of the compression bodies toward the respective media loading position for disengaging the compression bodies from the structural building block thereby promoting discharging of the structural building block.

In at least one embodiment of the present invention, moving the compression case to the block discharging position includes limiting longitudinal movement of the compression bodies along a longitudinal reference axis of the compression body receiving passage while moving the compression case to the block discharging position and positioning a block discharge opening of the compression case laterally between the two opposed compression bodies.

These and other objects, embodiments advantages and/or distinctions of the present invention will become readily apparent upon further review of the following specification, associated drawings and appended claims.

DETAILED DESCRIPTION OF THE DRAWING FIGURES

Figure 1:
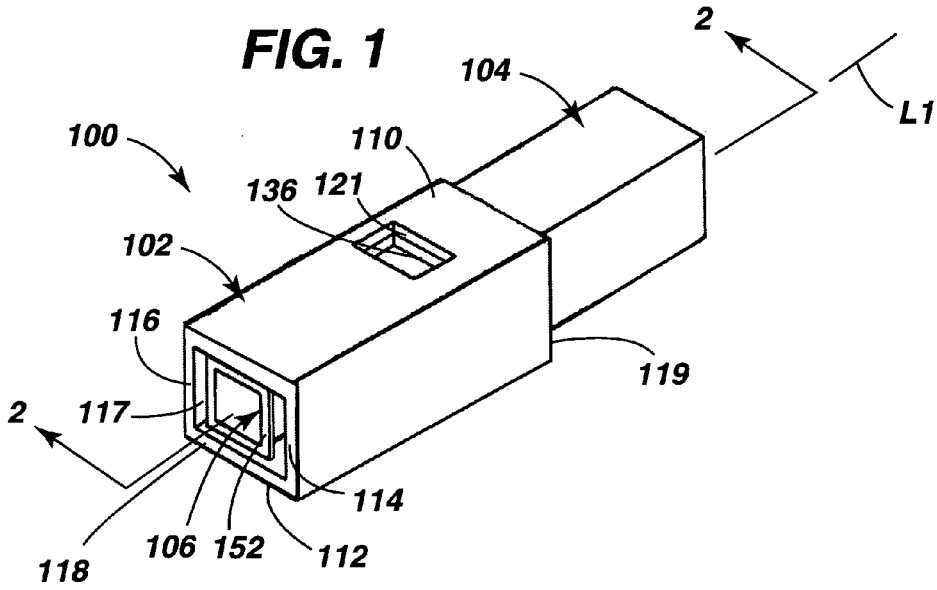
FIG. 1 depicts an embodiment of a block forming apparatus in accordance with the present invention.
Figure 2:
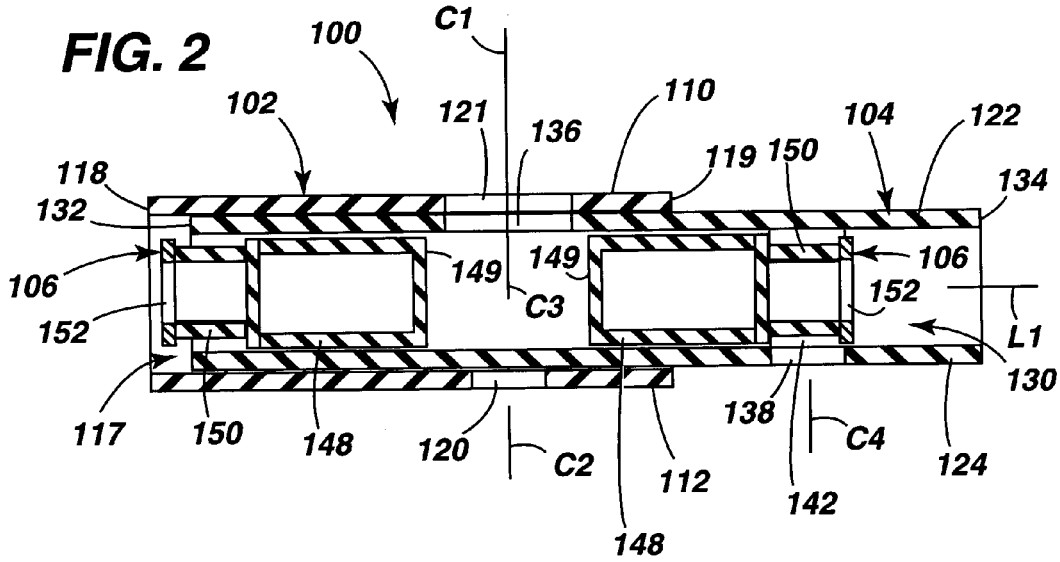
FIG. 2 is a cross Seconal view taken along the line 2—2 in FIG. 1.
Figure 3:
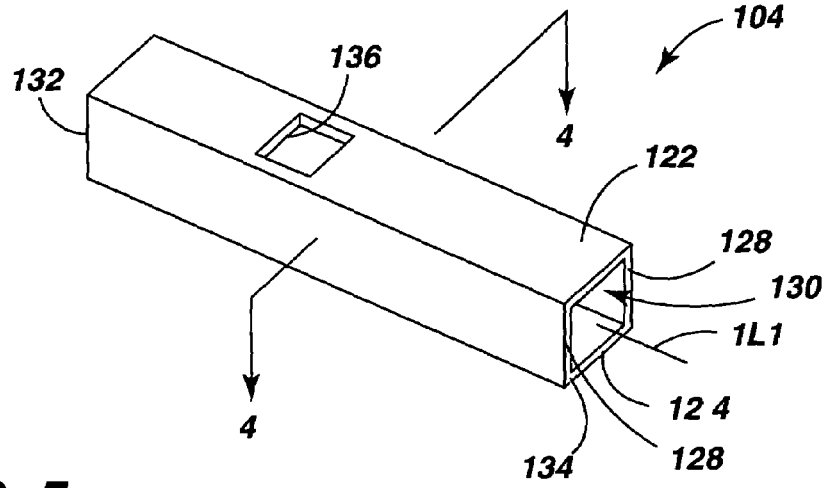
FIG. 3 is a perspective view showing a compression case of the block forming apparatus depicted in FIG. 1.

FIGS. 1 and 2 depict an embodiment of a block forming apparatus in accordance with the present invention, which is referred to herein as the block forming apparatus 100. The block forming apparatus 100 includes a frame 102, a compression case 104 and two opposed compression bodies 106. As is discussed in greater detail below, the frame 102, the compression case 104 and the two opposed compression bodies 106 are configured and interoperable in a manner that enabling the block forming apparatus 100 to carry out block fabrication functionality in accordance with present invention (e.g., in accordance with the method 200 disclosed herein).

As will become apparent in the ensuing discussion, the block forming apparatus 100 advantageously has a substantially integrated construction such that may be readily implemented into a block press having a substantially modular construction (i.e., the block forming apparatus 100 is a component of such modular construction). Alternatively, the block forming apparatus 100 may be implemented in a block press in a non-modular and/or non-interchangeable manner. Additionally, the block press apparatus 100 may be used in a block press configured for having a single block press apparatus mounted thereon at any point in time or a plurality of block press apparatuses mounted thereon at any point in time.

In the depicted embodiment, the frame 102 is preferably, but not necessarily, an elongated rectangular cross-section tube having an upper wall 110, a lower wall 112 and spaced apart side walls (114, 116). The frame 102 includes compression case receiving passage 117 defined by interior surfaces of the walls (110–116) of the frame 102. The compression case receiving passage 117 extends between opposed end faces (118, 119) of the frame 102.

A media fill opening 121 extends through the upper wall 110 of the frame 102 and a block discharge opening 120 extends through the lower wall 112 of the frame 102 such that the media fill opening 121 and the block discharge opening 120 are communicative with the compression case receiving passage 117. Preferably, but not necessarily, a central axis C1 of the media fill opening 121 is aligned with a central axis C2 of the block discharge opening 120 (FIG. 2). It is disclosed herein that the central axes (C1, C2) of the media fill opening 121 and the block discharge opening 120 need not be fully aligned with each other.

Referring now to FIGS. 1–4, the compression case 104 is slideably engaged within the compression case receiving passage 117 of the frame 102. The slideable engagement between the frame 102 and the compression case 104 enables movement of the compression case 104 relative to the frame 102 along a longitudinal reference axis L1 of the compression case 104. In the depicted embodiment, the compression case 104 is preferably, but not necessarily, an elongated rectangular cross-section tube having an upper wall 122, a lower wall 124 and spaced apart side walls (126, 128). Interior surfaces of the walls (122–128) of the compression case 104 define a compression body receiving passage 130 (FIGS. 2 and 4) extending between opposed end faces (132, 134) of the compression case 104 along the longitudinal reference axis L1. A media fill opening 136 extends through the upper wall 122 of the compression case 104 and a block discharge opening 138 extends through the lower wall 124 of the compression case 104. The media fill opening 136 of the compression case 104 and the block discharge opening 138 of the compression case 104 are communicative with the compression body receiving passage 130.

The respective interior surface of each one of the side walls (126, 128) has a respective block release recess (140, 142) therein. The block release recesses (140, 142) extending between the upper wall 122 and the lower wall 124. The block release recesses (140, 142) are positioned between a forward lateral edge 144 of the block discharge opening 138 and a rear lateral edge 146 of the block discharge opening 138. Preferably, a width of each one of the block release recess (140, 142) is the same as a length of the block discharge opening.138. A central axis C3 of the media fill opening 136 of the compression case 104 is offset from a central axis C4 of the block discharge opening 138 of the compression case 104.

At a minimum, the central axis C3 of the media fill opening 136 of the compression case 104 is offset from the central axis C4 of the block discharge opening 138 by a distance equal to a length of the media fill opening 136 of the compression case 104. It is disclosed herein that, in an alternate embodiment of the compression case 103 (not shown), the block discharge opening 138 intersects adjacent end 134 of the compression case 104. In such an alternate embodiment, the adjacent end 134 of the compression case 104 defines the rear lateral edge 146 of the block discharge opening 138.

Preferably, dimensions of the block discharge opening 120 of the frame 102 are the same as or larger than the corresponding dimensions of the block discharge opening 138 of the compression case 104. Similarly, it is preferable that dimensions of the media fill opening 121 of the frame 102 are the same as or larger than the corresponding dimensions of the media fill opening 138 of the compression case 104.

It is disclosed herein that the frame 102 and the compression case 104 may optionally both have a different cross sectional shape than rectangular. Examples of such different cross-sectional shapes include, but are not limited to, round, hexagonal, etc. In view of the disclosures made herein, a skilled person will appreciate that the present invention is not necessarily limited to a particular cross-sectional shape of the frame 102 or the compression case 104. Additionally, a skilled person will appreciate that the frame 102 may be a non-tubular structure (e.g., an open chassis) while still providing for the required functionality of movable engagement with the compression case 104 and necessary engagement of the block forming apparatus 100 by a block press.

Figure 5:
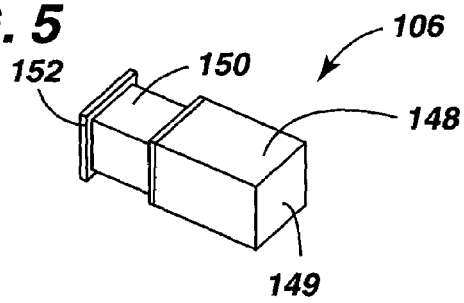
FIG. 5 is a perspective view showing a compression body of the block forming apparatus depicted in FIG. 1.
Figure 4:
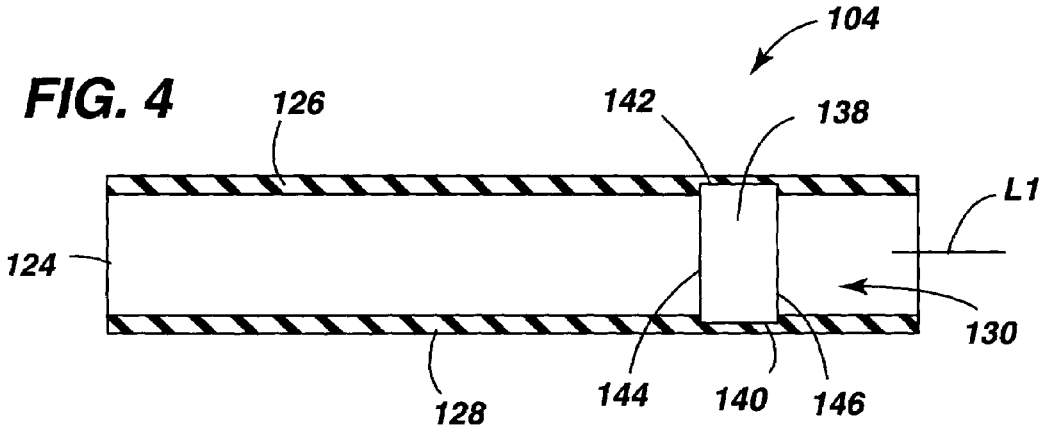
FIG. 4 is a cross Seconal view taken along the line 4—4 in FIG. 3.

Referring now to FIGS. 1, 2 and 5, each compression body 106 is slideably mounted within the compression body receiving passage 130 of the compression case 104. Thus, each compression body 106 is mounted in a manner enabling movement (i.e., simultaneous, independent and/or linked) of each compression body 106 along the longitudinal reference axis L1 of the compression case 104. In the depicted embodiment, each compression body 106 has a media compaction portion 148 and an actuator engagement portion 150 connected to the media compaction portion 148. An inboard face 149 of the media compaction portion 148 may be substantially flat, may be partially flat with a non-flat feature or may be substantially contoured. The media compaction portion 148 of each compression body 106 has a relatively low clearance fit (i.e., an intimate fit) within the compression body receiving passage 130 and, preferably, a length of the media compaction portion 148 is relatively long with respect to cross-sectional dimensions of the compression body receiving passage 130 to limit a tendency for rocking within compression body receiving passage 130. The actuator engagement portion 150 includes a generally flat engagement flange 152. The engagement flange enables distributed delivery of a force onto the compression body 106 through a force application means such as, for example, a force application platen connected to a hydraulic cylinder.

Preferably, but not necessarily, the actuator engagement portion 150 of each compression body 106 is sized to provide a relatively large clearance between perimeter edges thereof and the interior surfaces of the walls (122–128) of the compression body 104. Optionally, all of the actuator engagement portion 150 of each compression body 106 or a portion of the actuator engagement portion 150 of each compression body 106 may have a relatively low clearance fit with the compression body receiving passage 130. Additionally, it is disclosed herein that the media compaction portion 148 of each compression body 106 may consist of a flat plate attached to the actuator engagement portion 150, such that the compression body essentially includes two flat plates having a rigid member (e.g., a steel tube) connected therebetween. Additionally, one or more other flat plates serving as intermediate support ribs may be attached to the rigid member at locations between the ends of the rigid member.

A skilled person will recognize that the various components of a block press in accordance with the present invention will preferably be made from suitably strong, rigid and durable materials. For example, in view of the disclosures made herein, it will be appreciated that a frame, a compression case and compression bodies in accordance with the present invention will preferably be made from one or a collection of pieces (e.g., welded, fastened with threaded fasteners, etc) of a hardened steel alloy material. Furthermore, interfaces subject to excessive wear from moving contact will preferably incorporate wear plates to limit such wear, enable adjustment to compensate for such wear and/or to enable replacement of worn contact surfaces. Such wear plates are preferably made from hardened steel alloy capable of withstanding high abrasion.

Now, we turn to a discussion of fabrication functionality of the block forming apparatus 100 for forming a structural building block. A method in accordance with the present invention, which is referred to herein as the method 200, is depicted in FIGS. 6–11. While the method 200 is depicted and discussed as being carried out in accordance with the block forming apparatus 100 depicted in FIGS. 1–5, a skilled person will appreciate that other apparatuses in accordance with the present invention are fully capable of carrying out the method 200.

Figure 6:
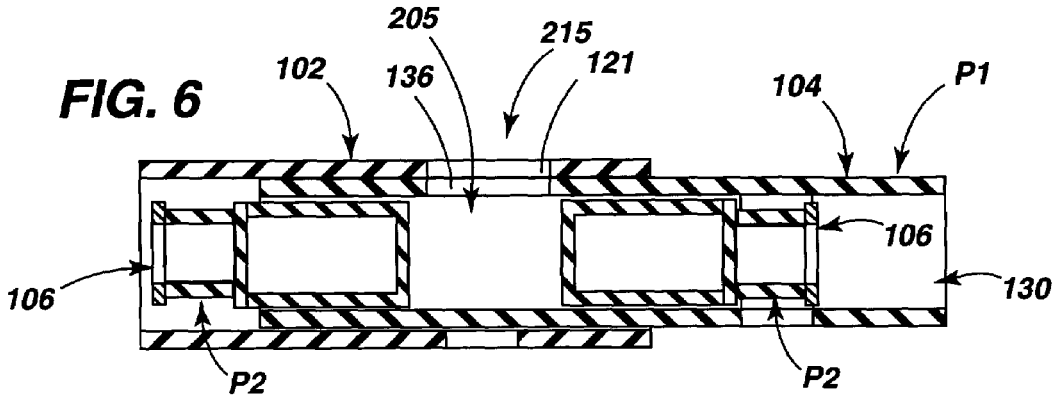
FIGS. 6–11 depict an embodiment of a method for forming a structural building block in accordance with the present invention.

Referring now to FIG. 6, a block fabrication cycle begins with facilitating relative positioning of the compression case 104 and each two compression body 106 for forming a media receiving cavity 205 within the compression body receiving passage 130 between the compression bodies 106. Relative to completion of a previously performed block fabrication cycle, facilitating such relative positioning for forming the media receiving cavity 205 includes moving the compression case 104 to a respective media loading position P1 relative to the frame 102 and moving each compression body 106 to a respective media loading position P2 relative to the compression case 104. With the compression case 104 in its respective media loading position P1 and each compression body 106 in its respective media loading position P2, the media receiving cavity 205 is provided within the compression body receiving passage 130 between the two compression bodies 106.

Figure 7:
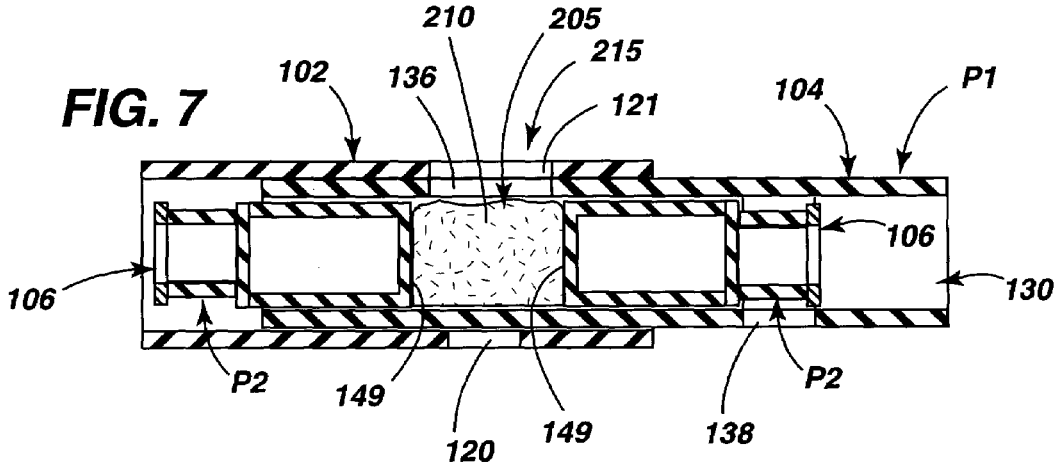

As depicted in FIG. 7, a volume of media 210 from which a building is made is deposited into the media receiving cavity 205 through an opening 215 defined by the media fill openings (119, 136) of the frame 102 and the compression case 104 after relative positioning of the compression case 104 and each two compression body 106 is performed for forming the media receiving cavity 205. Examples of such media 210 include, but are not limited to, freshly dug soil, conditioned soil (e.g., aerated soil) and soil enhanced with known binding material and/or known filler material. It is disclosed herein that the media may be deposited through use of any number of media delivery and/or conditioning apparatuses. In view of the disclosures made herein, a skilled person will identify and/or devise one or more media delivery and/or conditioning apparatuses suitable for delivering media in a relatively low-density form to the media receiving cavity 205. Thus, such media delivery and/or conditioning apparatuses will not be discussed herein in further detail.

It is disclosed herein that the volume of media 210 will preferably be of a relatively low density with respect to the density of media in corresponding formed structural building block. In one embodiment of the present invention, the volume of the media 210 delivered to the media receiving cavity 205 is quantitatively determined prior to or in conjunction with the volume of media 210 being deposited in the media receiving cavity 205. In another embodiment, a length of deposit time is correlated to the volume of media 210. In yet another embodiment, a weight is correlated to the volume of media 210. In still another embodiment, a fill level of media within the media receiving cavity 205 is determined in conjunction with delivery of the volume of media 210.

Figure 8:
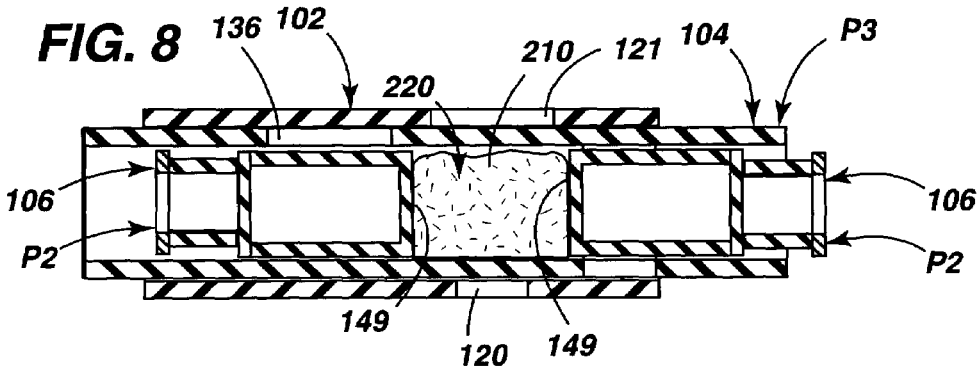

After the volume of media 210 is deposited within the media receiving cavity 205, relative positioning of the compression case 104 is facilitated for closing an entry 215 into the media receiving cavity 205 through which the volume of media 210 was deposited (FIG. 8). Facilitating relative positioning of the compression case 104 for closing the entry 215 includes moving the compression case 104 to a chamber sealing position P3 relative to the media fill opening 121 of the frame 102. In the chamber sealing position P3, the media fill opening 136 of the compression case 104 is entirely offset from the media fill opening 121 of the frame 102. Upon closing of the entry 215, the space within the compression body receiving passage 130 between the two compression bodies 106 becomes a media compression chamber 220 (i.e., a generally sealed chamber).

Figure 9:
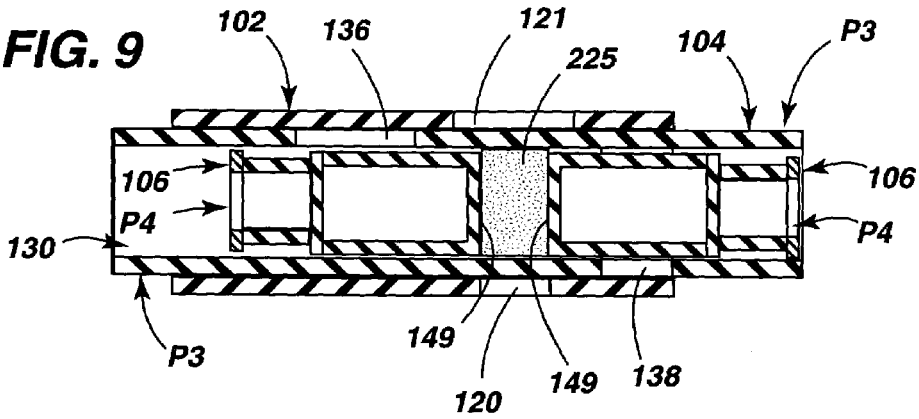
Figure 10:
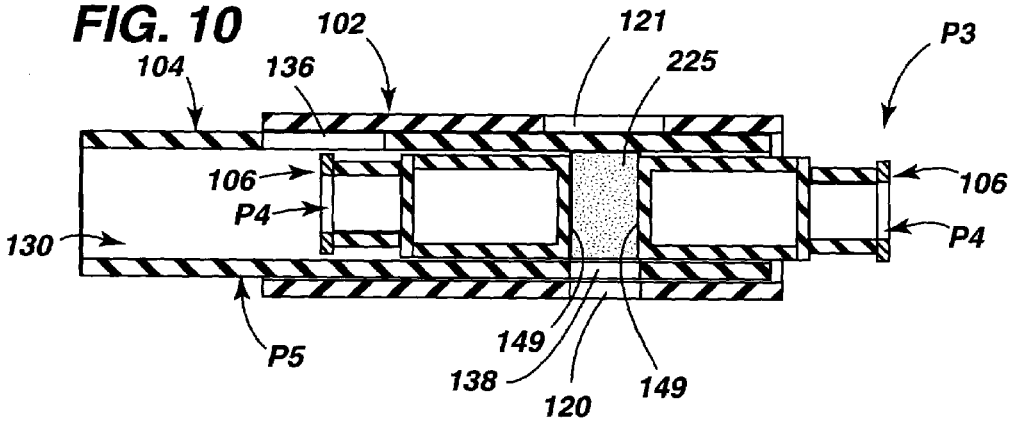

Next, as depicted in FIG. 9, each compression body 106 is moved toward the other compression body 106 under sufficient applied force t o compress the volume of media 210 into a structural building block 225. A compressed volume and shape of the structural building block 225 corresponds to the cross sectional shape and cross-sectional area of the compression body receiving passage 130 and a distance between the inboard face 149 of each compression body 106 when each compression body 106 is in a fully displaced position P4. In one embodiment of the present invention, longitudinal displacement of each compression body 106 is determined for enabling assessment of a degree of compaction of the volume of media 210 and/or for enabling assessment of physical dimensions of the structural building block 225.

With, the volume of media 210 (FIG. 8) compressed into the structural building block (FIG. 9), relative positioning of the compression case 104 and the compression bodies 106 is facilitated for enabling discharge of the structural building block 225 from within the compression chamber 220 through the block discharge openings 120 of the frame 102 and through the block discharge opening 138 of the compression case 104. Facilitating relative positioning for enabling discharge includes moving the compression case 104 to a block discharging position P5 with respect to the compression bodies 106 and removing all or a portion of the applied force on the compression bodies 106 whereby the compression bodies 106 are in substantially non-compressing engagement with the structural building block 225. The operation of removing all or a portion of the applied force on the compression bodies 106 by the compression bodies 106 reduces the potential for pressure exerted by the compression bodies 106 resulting in damage to the structural building block 225 as the compression case 104 is moved from the chamber sealing position P3 to the block discharging position P5. Moving the compression case 104 to the block discharging position P5 includes limiting longitudinal movement of the compression bodies 106 while moving the compression case 104 to the block discharging position P5. In the block discharging position P5 (FIG. 10), a central axis C3 of the block discharge opening 138 of the compression case 104 is aligned with a central axis C4 of the block discharge opening 120 of the frame 102 and the block discharge opening 138 of the compression case 104 is laterally between the inboard faces 149 of the compression bodies 106.

Figure 11:
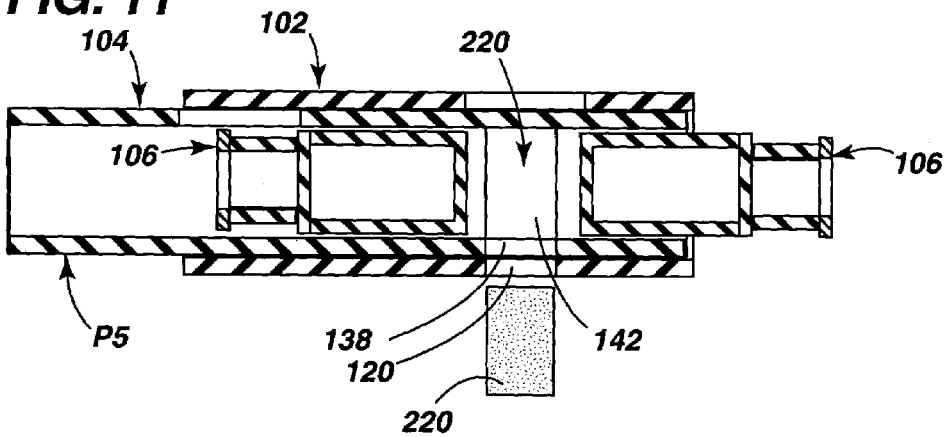

With the compression case 104 in the block discharging position P5, the compression bodies 106 are moved toward the respective media loading position P2 (FIG. 11). Moving the compression bodies toward their respective media loading position P2 disengages the compression bodies 106 from the structural building block 225. This disengagement in conjunction with structural building block 225 being exposed to the block release recesses (140, 142) of the compression case 104 promotes discharging of the structural building block 225 from within the compression body receiving passage 130 of the compression case 104. Discharge of the structural building block 225 completes the block fabrication cycle.

It is disclosed herein that a vibratory apparatus may be attached to each compression body 106 and/or to the compression case 104. In compressing media to form the structural building block 225, portions of the media engaged with each compression body 106 may sometimes have a tendency to stick to one of the engaged compression bodies 106.

Attachment of a vibratory apparatus to each compression body 106 and activation of the vibratory apparatus just prior to when the engaged compression bodies 106 is moved toward its respective media loading position P2 will contribute to releasing media of the structural building block 225 from engaged compression bodies 106. In doing so, the tendency for a surface of the structural building block 225 being damaged through the act of retracting the engaged compression bodies 106 is reduced.

Additionally, it is disclosed herein that the vibratory apparatus may be activated during the media fill operation. In doing so, density of the media 210 is increased by virtue of vibrations from the vibratory apparatus causing entrapped air in the media to be released.

It is disclosed herein that only one compression body 106 need be movable (i.e., the moving compression body) for forming structural building blocks through use of the block forming apparatus 100. One compression body (i.e., the stationary compression body) may be maintained in a fixed position via a substantially rigid member such as, for example, a beam connected between a chassis bulkhead and the stationary compression body. In the case of a block forming apparatus implemented with one movable compression body and one stationary compression body, an inboard face of the media compaction portion of the face the stationary compression body is aligned with an edge of the media fill opening 121 of the frame 102 (i.e., the media fill opening 121 positioned between inboard faces 149 of the compression bodies 106) and with an edge of the block discharge opening 120 of the frame 102 (i.e., the block discharge opening 120 positioned between inboard faces 149 of the compression bodies 106). Such alignment allows for block in accordance with the method 200 with the exception that only one compression body 106 is moved relative to the frame 102.

Figure 12:
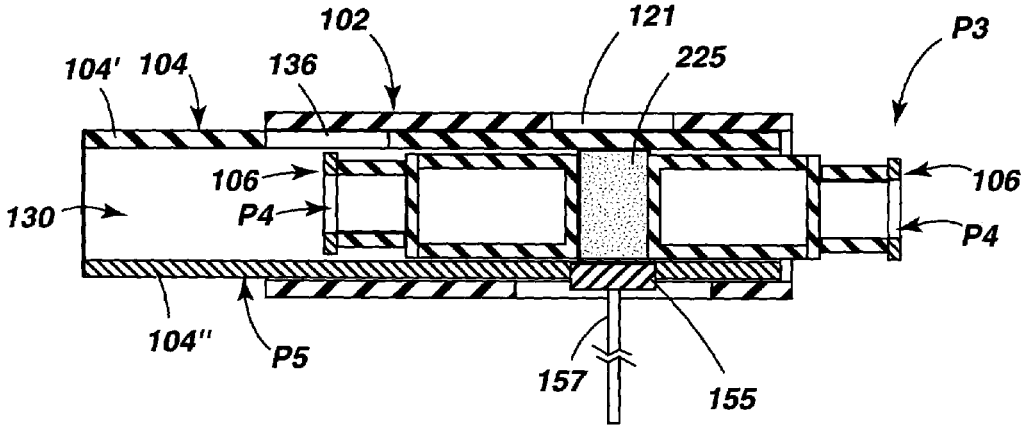
FIGS. 12 and 13 depicts an alternate construction and operation of the block forming apparatus depicted in FIG. 1 and FIGS. 6–11.
Figure 13:
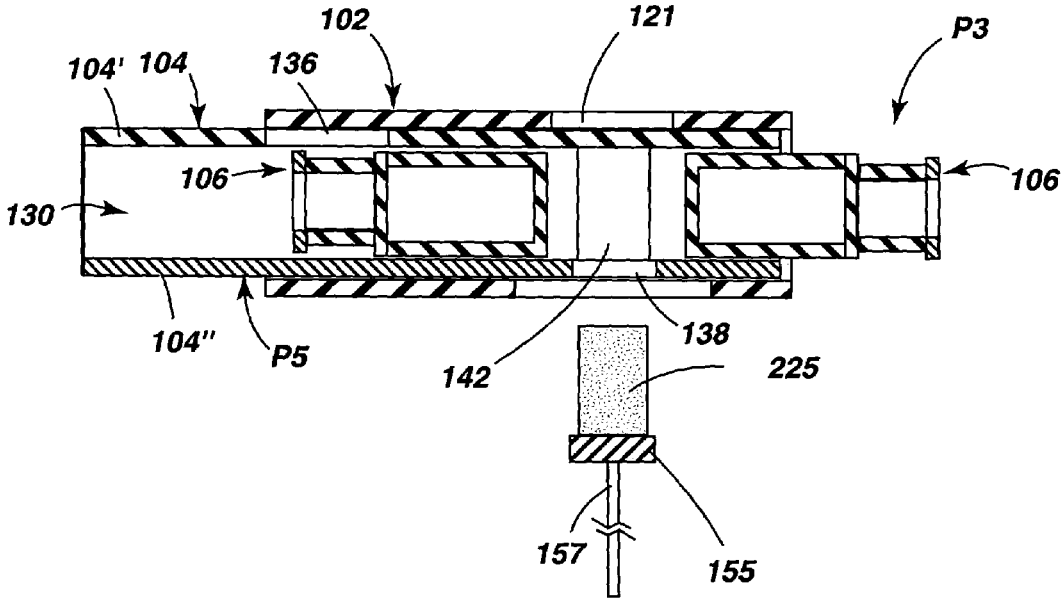

FIGS. 12 and 13 depict an alternate embodiment of the block forming apparatus 100 depicted in FIGS. 1 and 6–11. In this alternate embodiment, the compression case 104 includes a movable portion 104' and a fixed portion 104". The movable portion 104' moves substantially the same as discussed in reference to FIGS. 6–9. The fixed portion is immovably attached to the frame 102 or to an immovable structure of a block press in which the block forming apparatus 100 is incorporated. The fixed portion 104" includes a cavity plate 155 connected to a cavity plate actuator 157. As depicted in FIG. 12, the cavity plate 155 resides within the block discharge opening 138 during the operations of loading media (discussed in reference to FIGS. 6 and 7), during the operations of compressing the media (discussed in reference to FIGS. 8 and 9) and during the operation of releasing load on the compression bodies 106 (discussed in reference to FIG. 9). For facilitating discharge of the structural building block 225 (see FIG. 13), the cavity plate actuator 157 (e.g., a hydraulic actuator) moves the cavity plate 155 such that the structural building block 225 is lowered via movement of the cavity plate 155. Thereafter, a manual or automated operation for indexing or removing the structural building block 225 is performed.

It is disclosed herein that all or a portion of the surface of the cavity plate 155 exposed within the compression receiving passage 130 of the compression body 104 may have a texture formed thereon. In this manner, a corresponding textured pattern is formed on a face of the structural building block 225 that is engaged with the cavity plate 155.

Figure 14:
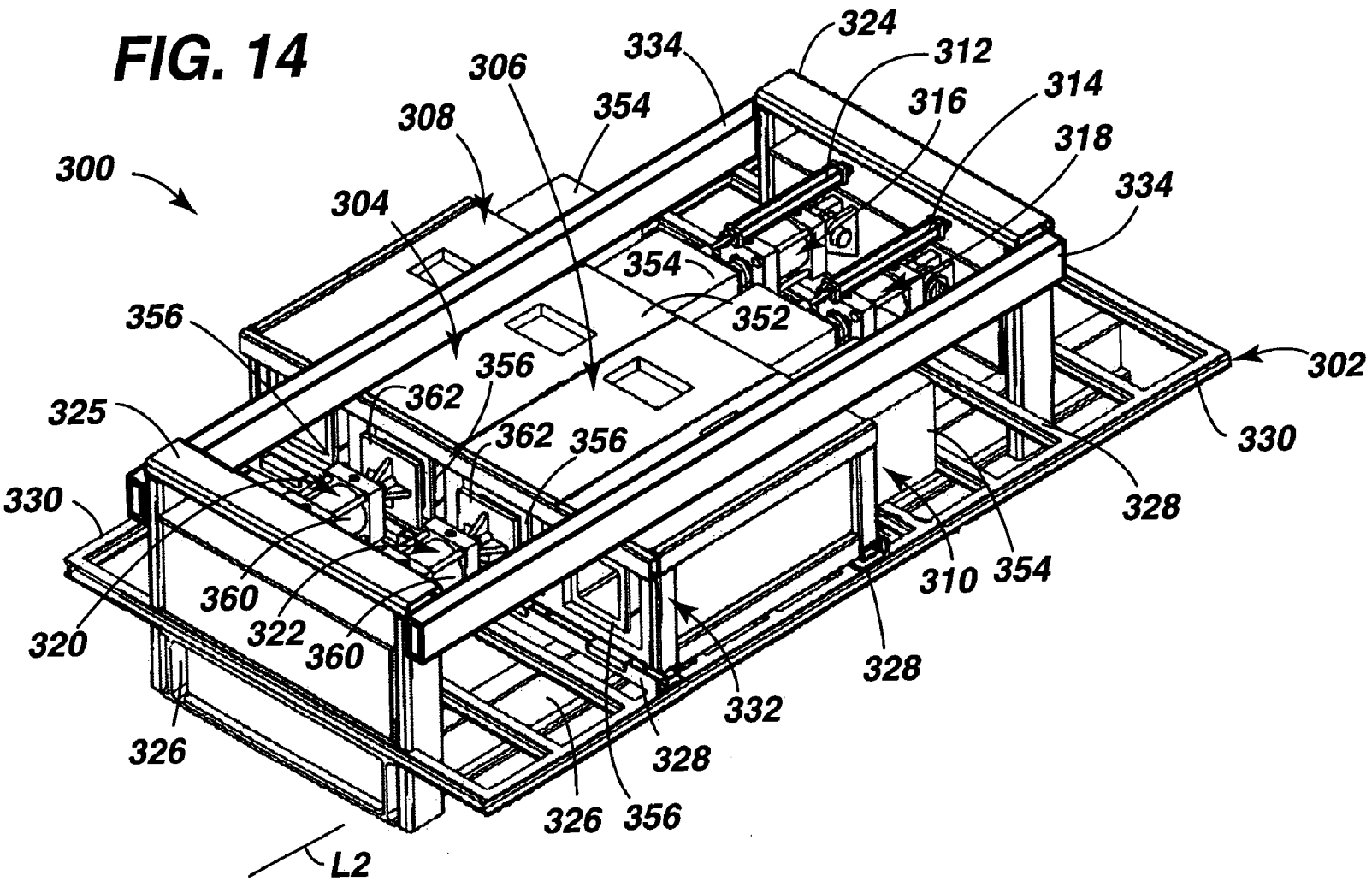
FIG. 14 depicts a block press in accordance with the present invention.

FIG. 14 depicts a block press in accordance with the present invention, which is referred to herein generally as the block press 300. The block press 300 includes a chassis 302, a plurality of block forming apparatuses (304–310), a plurality of compression case actuators (312, 314) and a plurality of compression body actuators (316–322). The chassis 302 includes spaced apart bulkheads (324, 325), a plurality of longitudinal main beams 326, a plurality of lateral support beams 328, a plurality of longitudinal support beams 330, a block forming apparatus carriage 332 and a plurality of upper support beams 334. The bulkheads (324, 325) are each attached at their lower end to the longitudinal main beams 326 in a spaced apart upright manner. The lateral support beams 328 are each attached to the longitudinal main beams 326 extending generally perpendicular in direction to that of the longitudinal main beams 326. The upper support beams 334 are attached between upper ends of the bulkheads (324, 325). The block forming apparatus carriage 332 is engaged with a plurality of the lateral support beams 328 between the bulkheads (324, 325).

As depicted in FIG. 14, the block forming apparatus carriage 332 and engaged ones of the lateral support beams 328 are jointly configured for enabling lateral movement of the block forming apparatus carriage 332 with respect of a longitudinal reference axis L2 of the chassis 302. However, it is disclosed herein that the block forming apparatus carriage 332 may be non-movable with respect to the chassis 302. Optionally, a block press apparatus in accordance with the present invention and configured substantially the same as the block press 300 may have only a single block press apparatus mountable thereon.

The plurality of block forming apparatuses (304–310) are mounted on the block forming apparatus carriage 332. Advantageously, each one of the block forming apparatuses (304–310) is self-contained and is preferably mounted in the block forming apparatus carriage 332 without the use of fasteners. For example, mating locating structures may be incorporated into the block forming apparatus carriage 332 and each one of the block forming apparatuses (304–310) for facilitating locating and retention functionality of the block forming apparatuses (304–310) with respect to the block forming apparatus carriage 332. Optionally, physical fastening means (e.g., threaded fasteners) may be used for locating and fastening each one of the block forming apparatuses (304–310) to the block forming apparatus carriage 332.

Each one of the block forming apparatuses (304–310) has a construction substantially the same the block forming apparatus 100 depicted and discussed in reference to FIGS. 1–13. Accordingly, for the remainder of this discussion, terminology used in the discussion of FIGS. 1–13 will be used in the discussion of the plurality of block forming apparatuses (304–310). The reader is encouraged to refer to the discussion of FIGS. 1–13 for additional details into the structure and function of the block forming apparatuses (304–310).

Each one of the block forming apparatus (304–310) includes a frame 352, a compression case 354 and two compression bodies 356. The frame 352 is releasably engaged with the block forming apparatus carriage 332. Each compression case 354 is movably engaged with a frame 352 of the respective block forming apparatus (304–310) in a manner enabling movement of the compression case 354 along a respective longitudinal reference axis. The respective longitudinal reference axis of compression case 354 of each block forming apparatus (304–310) extends substantially parallel with the longitudinal reference axis L2 of the chassis 302. The compression case 354 of each block forming apparatus (304–310) has a compression body receiving passage extending between opposed end faces thereof along the respective longitudinal reference axis of the compression case 354. Each block forming apparatus (304–310) has two compression bodies 356 movably mounted within the compression body receiving passage of the compression case in a manner enabling movement of the compression bodies 356 along the longitudinal reference axis of the compression case 354.

A first compression case actuator 312 is connected between the first bulkhead 324 and the compression case 354 of a first block forming apparatus 304. A second compression case actuator 316 is connected between the first bulkhead 324 and the compression case 354 of a second block forming apparatus 306. Each one of the compression case actuators (324, 325) is connected between one of the bulkheads and a respective one of the block forming apparatuses (304–310) for facilitating movement of the attached compression case to accomplish positioning functionality as discussed in reference the method of FIGS. 6–11. A hydraulic cylinder is an example of each one of the compression case actuators (324, 325).

Each compression case actuator (312, 314) is releasably connected to the respective compression case and is pivotably connected to the first bulkhead 324. This releasable and pivotable mounting configuration advantageously allows each compression case actuator (312, 314) to be independently disconnected from the respective compression case and pivoted out of the way, which is useful when servicing, replacing or switching position of one or more of the block fabrication apparatuses (304–310).

A first compression body actuator 316 and a second compression body actuator 318 are attached to the first bulkhead 324. A third compression body actuator 320 and a fourth compression body actuator 322 are attached to the second bulkhead 324. The first compression body actuator 316 is longitudinally aligned with the third compression body actuator 320. The second compression body actuator 318 is longitudinally aligned with the fourth compression body actuator 322. Spacing between the first compression body actuator 316 and the second compression body actuator 318 is substantially the same as the spacing between longitudinal reference axes of the adjacent block fabrication apparatuses (304–310). Spacing between the third compression body actuator 320 and the fourth compression body actuator 322 is substantially the same as the spacing between longitudinal reference axes of the adjacent block fabrication apparatuses (304–310).

The compression body actuators (316–322) each include a force generating device 360 (e.g., a hydraulic cylinder) and a platen 362 attached to the force generating device 360. A first end of the force generating device 360 is attached to a respective one of the bulkheads (324, 325). A second end of the force generating device 360 is attached to the platen 362. Through lateral positioning of the block forming apparatus carriage 332, two adjacent ones of the block fabrication apparatuses (304–310) are aligned with in line-pairs of the compression body actuators (316–322). For example, as depicted in FIG. 14, the block forming apparatus carriage 332 is positioned such that the first compression body actuator 316 and the and third compression body actuator 320 are aligned with the first block forming apparatus 304 and the second compression body actuator 318 and the and fourth compression body actuator 322 are aligned with the second block forming apparatus 306.

Each force generating device 360 delivers a force to the respective compression body 356 by application of such force through the platen 362 (e.g., via engagement with a flange of an actuator engagement portion of the compression body 356). Accordingly, each force generating device 360 is capable of facilitating movement of a respective compression body 356 toward an opposing compression body 356. Retraction of two opposed compression bodies can be facilitated by one of any number of different approaches. For example, each platen 362 may be physically attached to a respective compression body 356 such that retraction of the platen 362 causes a corresponding retraction of the attached compression body 356.

However, for reasons of time and convenience, it is preferable that the compression body actuators (316–322) are not physically attached to the compression bodies 356 such that the block forming apparatuses (304–310) can be removed, replaced and/or serviced without requiring disconnection from the compression body actuators (316–322). To this end, it is disclosed herein that each block forming apparatuses (304–310) may be configured for facilitating self-retraction of each compression body 356. For example, a return spring may be attached between each compression body 356 and a respective compression case 354 or a respective frame 352 for returning the compression body 356 to a static position (e.g., no appreciable force applied by the return spring) from a displaced position (i.e., a position corresponding to full compression of a structural building block).

It is disclosed herein that platen spacers may be attached to a compression block engagement face of one or more platen 362 for adjusting a displaced distance of a respective one of the compression bodies 306. In such an arrangement, a space is provided between the plate 362 and the respective compression body 306. Accordingly, a portion of the total travel of the respective compression body actuator 322 is used for accomplishing contact between the platen 362 and the compression body 306. Through use of such spacers, the amount of travel of the respective compression body actuator 322 may be adjusted.

It is disclosed herein that the static position of each compression body may be adjustable such that a media receiving cavity length is adjustable. For example, a compression body limiter may be adjustable attached to a frame of a block press apparatus such that an adjusted position of the compression body limiter dictates the static position of the compression body. Examples of the usefulness in being able to readily vary the volume of the media receiving cavity include, but are not limited to, compensating for media density for a given block size, providing for different block sizes and limiting compression body stroke.

Through the disclosed construction of the block press 300, the block press 300 is specifically configured for simultaneously making up to two blocks. However, as depicted, one pair of opposed compression body actuators can be deactivated/removed, allowing for only one block to be made per block making cycle. Also, it is disclosed herein that the chassis 302 can be configured for allowing the addition of compression body actuators and compression case actuators such that all of the block forming apparatuses (304–310) may simultaneously make building blocks.

Through implementation of a plurality of block forming apparatuses (304, 310), building blocks of different configuration (e.g., sizes, shapes, textures, colors, etc) can be readily made without the need to remove and install new block forming apparatuses. Lateral adjustment of the block forming apparatus carriage 332 enables selection of the block forming apparatuses (304–310), which will be presently active. Also, relative positioning of the installed block forming apparatuses (304–310) within the block forming apparatus carriage 332 can be facilitated as needed to achieve a desired mix of blocks configurations. As depicted, the block press 300 is configured for enabling up to 4 different configurations of blocks to be made without the need to remove and install new block forming apparatuses. If desired, multiple block forming apparatuses (304, 310) of the block press can be used for making the same configuration building block (e.g., simultaneously making two blocks of the same configuration).

A skilled person will recognize that any number of different systems may be utilized for facilitating control of a block press in accordance with the present invention (e.g., the block press 300) for carrying out a block fabrication method in accordance with the present invention (e.g., the method 200). More specifically, it will be appreciated that a programmable control unit (e.g., a programmable logic control unit) may be used to control one or more hydraulic pumps, one or more control valves and other known control components in a manner suitable for carrying out block fabrication functionality in accordance with the present invention. For example, through the use of position sensors for sensing movement and/or position of components of a block press in accordance with the present invention and by controlling delivery of pressurized hydraulic fluid to actuators of such a block press, required movement and positioning of such block press components may be accomplished. However, the present invention is not limited by such chosen, known control solutions. Different known control solutions of various configurations may be used with equal or suitable success in controlling a block press and/or method in accordance with the present invention.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A block press, comprising:

a frame;

a compression case movably engaged with the frame in a manner enabling selective movement of the compression case along a longitudinal reference axis of the compression case, wherein the compression case has a compression body receiving passage extending between opposed end faces thereof along the longitudinal reference axis, wherein the compression case includes a media fill opening within an upper wall thereof and a block discharge opening within a lower wall thereof and wherein the media fill opening and the block discharge opening are each communicative with the compression body receiving passage;

compression bodies movably mounted within the compression body receiving passage of the compression case in a manner enabling movement of said compression bodies along the longitudinal reference axis of the compression case; and means for imparting force for causing said selective movement connected to the compression case.

2. The block press of claim 1 wherein:

the compression case includes side walls extending between the upper wall of the compression case and the lower wall of the compression case;

the upper wall, the lower wall and said side walls each include a respective interior surface that jointly define the compression body receiving passage;

the respective interior surface of each one of said side walls has a block release recess therein extending between the upper wall and the lower wall; and the block release recess in each one of said side walls is positioned between a forward lateral edge of the block discharge opening and a rear lateral edge of the block discharge opening.

3. The block press of claim 1 wherein the block discharge opening intersects an end of the compression case.

4. The block press of claim 1 wherein:

at least one of said compression bodies has a media compaction portion and an actuator engagement portion connected to the media compaction portion;

the media compaction portion has an intimate fit within the compression body receiving passage; and the actuator engagement portion includes a generally flat engagement flange.

5. The block press of claim 1 wherein:

the compression case includes side walls extending between the upper wall of the compression case and the lower wall of the compression case;

the upper wall, the lower wall and said side walls each include a respective interior surface that jointly define the compression body receiving passage;

the respective interior surface of each one of said side walls has a block release recess therein extending between the upper wall and the lower wall; and the block release recess in each one of said side walls is positioned between a forward lateral edge of the block discharge opening and a rear lateral edge of the block discharge opening.

6. The block press of claim 5 wherein:

at least one of said compression bodies has a media compaction portion and an actuator engagement portion connected to the media compaction portion;

the media compaction portion has an intimate fit within the compression body receiving passage; and the actuator engagement portion includes a generally flat engagement flange.

7. A block press, comprising:

a chassis including spaced apart bulkheads;

a block forming apparatus carriage engaged with the chassis between said bulkheads;

a block forming apparatus including a frame, a compression case and two compression bodies, wherein the frame is releasably engaged with the block forming apparatus carriage; wherein the compression case is movably engaged with the frame in a manner enabling movement of the compression case along a longitudinal reference axis of the compression case, wherein the compression case has a compression body receiving passage extending between opposed end faces thereof along the longitudinal reference axis and wherein said compression bodies are movably mounted within the compression body receiving passage of the compression case in a manner enabling movement of said compression bodies along the longitudinal reference axis of the compression case;

a compression case actuator engaged between one of said bulkheads and the block forming apparatus for facilitating said movement of the compression case;

a first compression body actuator engaged between a first one of said compression bodies and a first one of said bulkheads for facilitating said movement of the first one of said compression bodies.

8. The block press of claim 7 wherein the block forming apparatus carriage and chassis are jointly configured for enabling lateral movement of the block forming apparatus with respect of a longitudinal reference axis of the chassis.

9. The block press of claim 7 wherein:

the first one of said compression bodies has a media compaction portion and an actuator engagement portion connected to the media compaction portion;

the media compaction portion has an intimate fit with walls of the compression body receiving passage;

the actuator engagement portion includes a generally flat engagement flange; and the first compression body actuator includes a platen engageable with the engagement flange for delivering a substantially distributed force thereto.

10. The block press of claim 9, further comprising:

a substantially rigid member engaged between a second one of said compression bodies and a second one of said bulkheads.

11. The block press of claim 10 wherein the block forming apparatus carriage and the block forming apparatus are jointly configured for enabling lateral movement of the block forming apparatus with respect of a longitudinal reference axis of the chassis.

12. The block press of claim 7, further comprising:

a second compression body actuator engaged between a second one of said compression bodies and a second one of said bulkheads;

wherein each one of said compression bodies has a respective media compaction portion and a respective actuator engagement portion connected to the respective media compaction portion;

the respective media compaction portion of each one of said compression bodies has an intimate fit with walls of the compression body receiving passage;

the respective actuator engagement portion of each one of said compression bodies includes a generally flat engagement flange; and each one of said compression body actuators includes a platen engageable with the engagement flange of a respective one of said compression bodies for delivering a substantially distributed force thereto.

13. The block press of claim 12 wherein the block forming apparatus carriage and the block forming apparatus are jointly configured for enabling lateral movement of the block forming apparatus with respect of a longitudinal reference axis of the chassis.

* * * * *